US011136795B2

(12) United States Patent
Im et al.

(10) Patent No.: US 11,136,795 B2
(45) Date of Patent: Oct. 5, 2021

(54) LATCH APPARATUS OF TAILGATE FOR VEHICLE

(71) Applicants: Hyundai Motor Company, Seoul (KR); Kia Motors Corporation, Seoul (KR)

(72) Inventors: Yong Hyuck Im, Seoul (KR); Jung Min Eom, Yeongtong-gu (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 1061 days.

(21) Appl. No.: 15/607,280

(22) Filed: May 26, 2017

(65) Prior Publication Data

US 2018/0073284 A1 Mar. 15, 2018

(30) Foreign Application Priority Data

Sep. 12, 2016 (KR) ..... 10-2016-0117434

(51) Int. Cl.
*E05B 81/14* (2014.01)
*E05B 81/34* (2014.01)
(Continued)

(52) U.S. Cl.
CPC ..... *E05B 81/34* (2013.01); *E05B 81/06* (2013.01); *E05B 81/14* (2013.01); *E05B 81/15* (2013.01);
(Continued)

(58) Field of Classification Search
CPC ..... E05B 81/34; E05B 81/06; E05B 81/20; E05B 81/14; E05B 81/15; E05B 81/66;
(Continued)

(56) References Cited

U.S. PATENT DOCUMENTS 6,848,727 B1 * 2/2005 Cetnar ..... E05B 81/20 292/201
7,341,290 B2 * 3/2008 Torka ..... E05B 81/20 292/201
(Continued)

FOREIGN PATENT DOCUMENTS

CN 1527902 A 9/2004
KR 1020050094147 A 9/2005
(Continued)

*Primary Examiner* — Kristina R Fulton
*Assistant Examiner* — Thomas L Neubauer
(74) *Attorney, Agent, or Firm* — Slater Matsil, LLP

(57) ABSTRACT

A latch apparatus of a tailgate for a vehicle is disclosed. The apparatus includes a base supporting a driving motor for supplying power and having an insertion groove for inserting a striker. A latch lever is rotatably disposed close to the insertion groove of the base. The latch lever is pushed to rotate when the striker is inserted into the insertion groove, and covers the striker inserted in the insertion groove. A release unit is disposed close to the latch lever on the base. The release unit is configured to transmit power from the driving motor, fix a position of the latch lever rotating to cover the striker, and allow the latch lever to rotate when the driving motor is operated. A cinching unit, operated by the power from the driving motor, is disposed close to the release unit on the base.

20 Claims, 6 Drawing Sheets

(51) Int. Cl.

| | |
|---|---|
| ***E05B 81/66*** | (2014.01) |
| ***E05B 81/06*** | (2014.01) |
| ***E05B 81/20*** | (2014.01) |
| ***E05B 83/18*** | (2014.01) |
| *E05B 81/12* | (2014.01) |
| *E05B 81/24* | (2014.01) |
| *E05B 81/32* | (2014.01) |
| *E05B 81/64* | (2014.01) |
| *E05B 83/16* | (2014.01) |

(52) U.S. Cl.
CPC ..... *E05B 81/20* (2013.01); *E05B 81/66* (2013.01); *E05B 83/18* (2013.01); *E05B 81/12* (2013.01); *E05B 81/24* (2013.01); *E05B 81/32* (2013.01); *E05B 81/64* (2013.01); *E05B 83/16* (2013.01)

(58) Field of Classification Search
CPC ..... E05B 83/18; E05B 81/12; E05B 81/24; E05B 81/32; E05B 81/64; E05B 83/16; E05B 81/16; B60J 5/10; E05Y 2900/546; E05Y 2400/44
See application file for complete search history.

(56) References Cited

U.S. PATENT DOCUMENTS

| | | | | |
|---|---|---|---|---|
| 7,380,844 | B2 | 6/2008 | Berghahn et al. | |
| 8,528,950 | B2 * | 9/2013 | Organek | E05B 17/007 292/216 |
| 8,684,424 | B2 | 4/2014 | Wattebled et al. | |
| 9,920,556 | B2 | 3/2018 | Byun et al. | |
| 2001/0010427 | A1 | 8/2001 | Roos | |
| 2004/0135378 | A1 | 7/2004 | Buedding et al. | |
| 2005/0206173 | A1 | 9/2005 | Lim | |

FOREIGN PATENT DOCUMENTS

| | | | |
|---|---|---|---|
| KR | 20060020691 | A | 3/2006 |
| KR | 20070046910 | A | 5/2007 |
| KR | 20100008098 | A | 1/2010 |
| KR | 20100019468 | A | 2/2010 |
| KR | 101338257 | B1 | 12/2013 |
| KR | 20160115569 | A | 10/2016 |

* cited by examiner

LATCH APPARATUS OF TAILGATE FOR VEHICLE

CROSS-REFERENCE TO RELATED APPLICATIONS

The present application claims priority to Korean Patent Application No. 10-2016-0117434, filed Sep. 12, 2016, the entire contents of which is incorporated herein for all purposes by this reference.

TECHNICAL FIELD

The present invention relates to a latch apparatus for opening/closing a tailgate of a vehicle.

BACKGROUND

In general, vehicles have a trunk at the rear portion to carry freight, and the trunk can be opened/closed for use, and has a latch apparatus that is locked/unlocked in conjunction with a striker on the car body.

Recently, a cinching latch apparatus for completely closing a trunk when the trunk is incompletely closed has been developed.

The cinching latch apparatus is changed into a second locking state from a first locking state when a trunk is closed.

To this end, the cinching latch of the related art includes a rotary latch receiving a striker, a rotary pole for locking the latch in a second stage when the latch is rotated, and a rotary cross lever to which the cinching latch is hinged to change the latch from the first locking state to the second locking state.

However, the cinching latch apparatus of the related art requires not only a plurality of latches for locking the striker, but a latch for cinching, so the overall size is increased and the structure is complicated.

The description provided above as a related art of the present invention is just for helping understanding the background of the present invention and should not be construed as being included in the related art known by those skilled in the art.

SUMMARY

The present invention has been made in an effort to solve the problems and completely lock a trunk that has been incompletely locked. In particular, an object of the present invention is to provide a latch apparatus for a tailgate of a vehicle, the apparatus having reduced size and weight by simplifying a cinching structure for completely closing a trunk.

In order to achieve the object of the present invention, a latch apparatus of a tailgate for a vehicle includes: a base supporting a driving motor for supplying power and having an insertion groove for inserting a striker; a latch lever rotatably disposed close to the insertion groove of the base being pushed to rotate when the striker is inserted into the insertion groove, and covering the striker inserted in the insertion groove; a release unit disposed close to the latch lever on the base, transmitting power from the driving motor, fixing the position of the latch lever rotating to cover the striker, and allowing the latch lever to rotate when the driving motor is operated; and a cinching unit disposed close to the release unit on the base, being operated by the power from the driving motor, and further rotating the latch lever to restrict the striker inserted in the insertion groove when the driving motor is operated with the latch lever covering the striker.

A first fixing protrusion protruding radially around the latch lever, a second fixing protrusion protruding to a height different from the first fixing protrusion, and a latch groove for inserting the striker may be sequentially formed at the latch lever.

The latch lever may have the latch groove, the second fixing protrusion, and the first fixing protrusion that are sequentially formed in the direction in which the latch lever is rotated when the striker is inserted, and the first fixing protrusion may protrude further than the second fixing protrusion.

The release unit may include: a main gear rotatably disposed on the base and rotated by power from the driving motor; and a release lever disposed close to the main gear and rotated in contact with the main gear within a predetermined rotational range of the main gear when the main gear is rotated.

The main gear may have an operating protrusion extending a predetermined length in a circumferential direction and the release lever may be rotatably disposed on the base with a first end positioned in the rotational radius of the operating protrusion according to the rotation of the main gear and a second end positioned in the rotational radius of the latch lever.

The release lever may include: a rotary bar rotatably disposed on the base and elastically supported to be rotated toward the latch lever; an operating bar disposed at a first end of the rotary bar to be rotated only in one direction, elastically supported to be returned to its initial position, and extending within the rotational radius of the operating protrusion; and a fixing bar rotatably disposed at a second end of the rotary bar and elastically supported to be rotated toward the latch lever.

A fixing projection may be formed on a side of the first end of the rotary bar to prevent the operating bar from rotating toward the fixing projection.

A first guide groove extending a predetermined distance in the rotational direction of the rotary bar may be formed in the base, and a first guide protrusion inserted in the first guide groove may be formed on the rotary bar, so the rotary bar may be rotated an amount corresponding to the length of the first guide groove.

A second guide groove extending a predetermined distance in the rotational direction of the fixing bar may be formed in the base, and a second guide protrusion inserted in the second guide groove may be formed on the rotary bar, so the fixing bar may be rotated an amount corresponding to the length of the second guide groove.

An engaging portion may protrude on the main gear, and the cinching unit may include: a sub-gear rotatably disposed on the base, engaged with the engaging portion, and rotated by the power from the driving motor; and a cinching lever disposed close to the sub-gear and rotated within a predetermined rotational range of the sub-gear in contact with the sub-gear when the sub-gear is rotated.

A locking portion may protrude on a side of the sub-gear, and the cinching lever may be rotatably disposed on the base with a first end positioned in the rotational radius of the locking portion depending on rotation of the sub-gear and a second end extending to be able to come in contact with the latch lever.

A locking protrusion may be formed on the latch lever to lock the second end of the cinching lever.

In the cinching lever, the first end extending toward the sub-gear and the second end extending to come in contact with the latch lever may form a predetermined angle therebetween.

The driving motor may be composed of a motor unit generating torque and a screw rotated by the torque from the motor unit, and the screw may be engaged with the main gear of the release unit.

A sensor sensing whether the striker is inserted and a controller controlling the driving motor and receiving signals from the sensor may be further disposed on the base, and when the striker is inserted in the insertion groove, the controller may operate the driving motor so that the cinching unit is operated and the latch lever is further rotated, thereby restricting the striker inserted in the insertion groove.

When an instruction to open a trunk is given, the controller may release the latch lever by operating the driving motor to operate the release unit.

The latch lever may be elastically supported to be rotated in the direction in which the striker is separated from the insertion groove.

According to the latch apparatus of a tailgate for a vehicle that has the structure described above, a tailgate that is incompletely closed is completely closed. In particular, it is possible to reduce the overall size and weight by simplifying the cinching structure for completely closing a trunk.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF ILLUSTRATIVE EMBODIMENTS

A latch apparatus of a tailgate for a vehicle according to an exemplary embodiment of the present invention is described hereafter with reference to the accompanying drawings.

Figure 1:
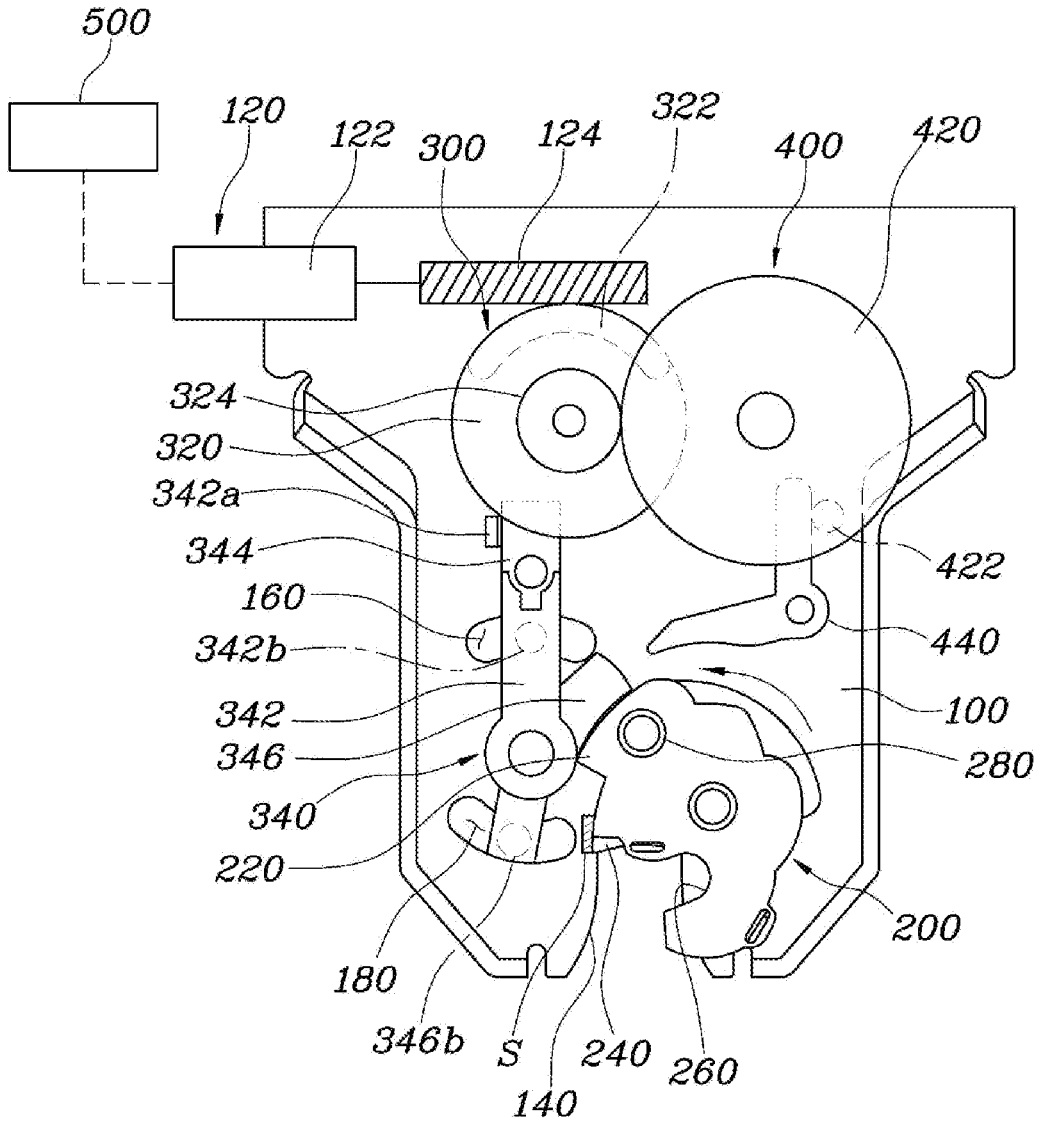
FIG. 1 is a view showing a latch apparatus of a tailgate for a vehicle according to an embodiment of the present invention.
Figure 2:
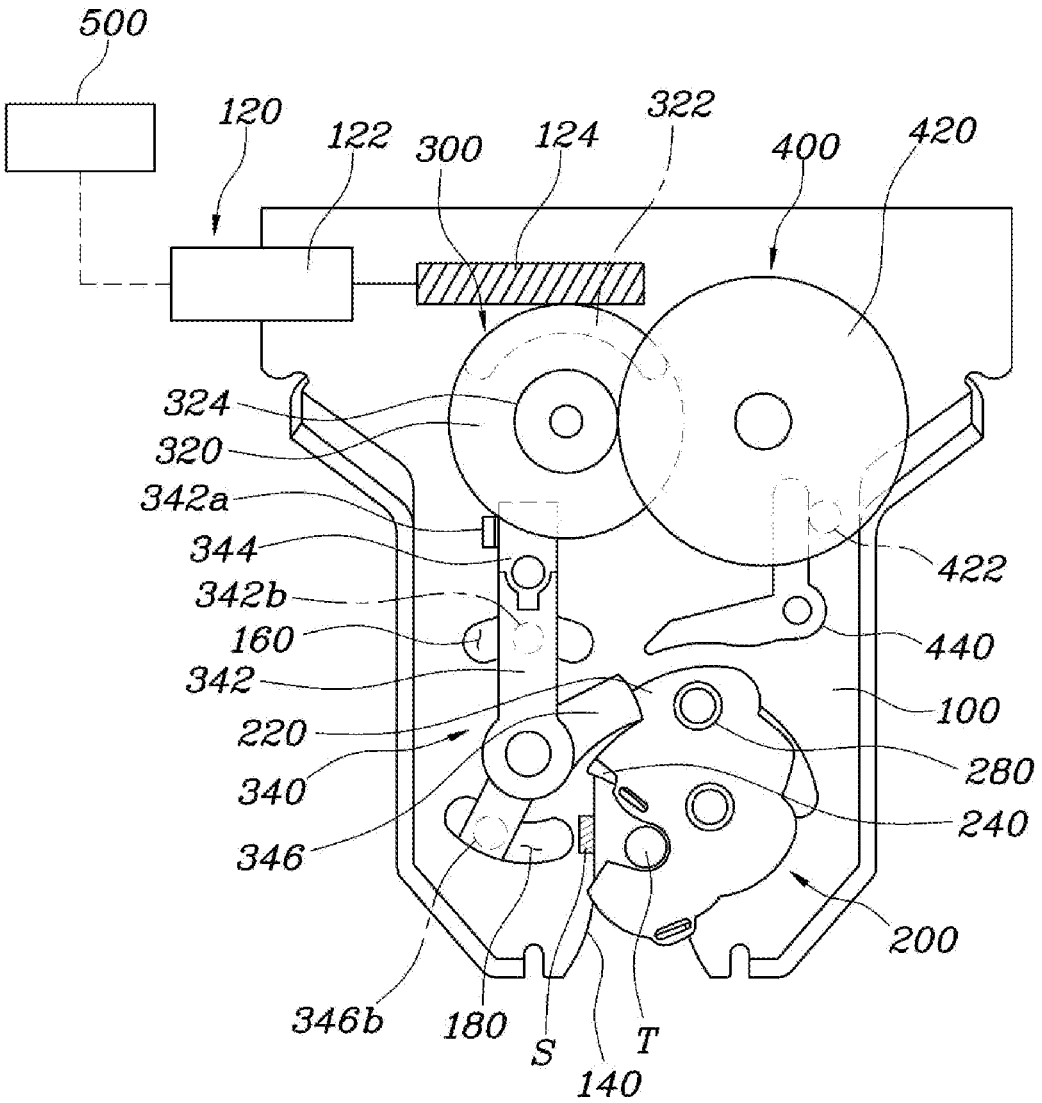
FIGS. 2 to 4 are views illustrating a closing operation of the latch apparatus of a tailgate for a vehicle according to an embodiment of the present invention.
Figure 3:
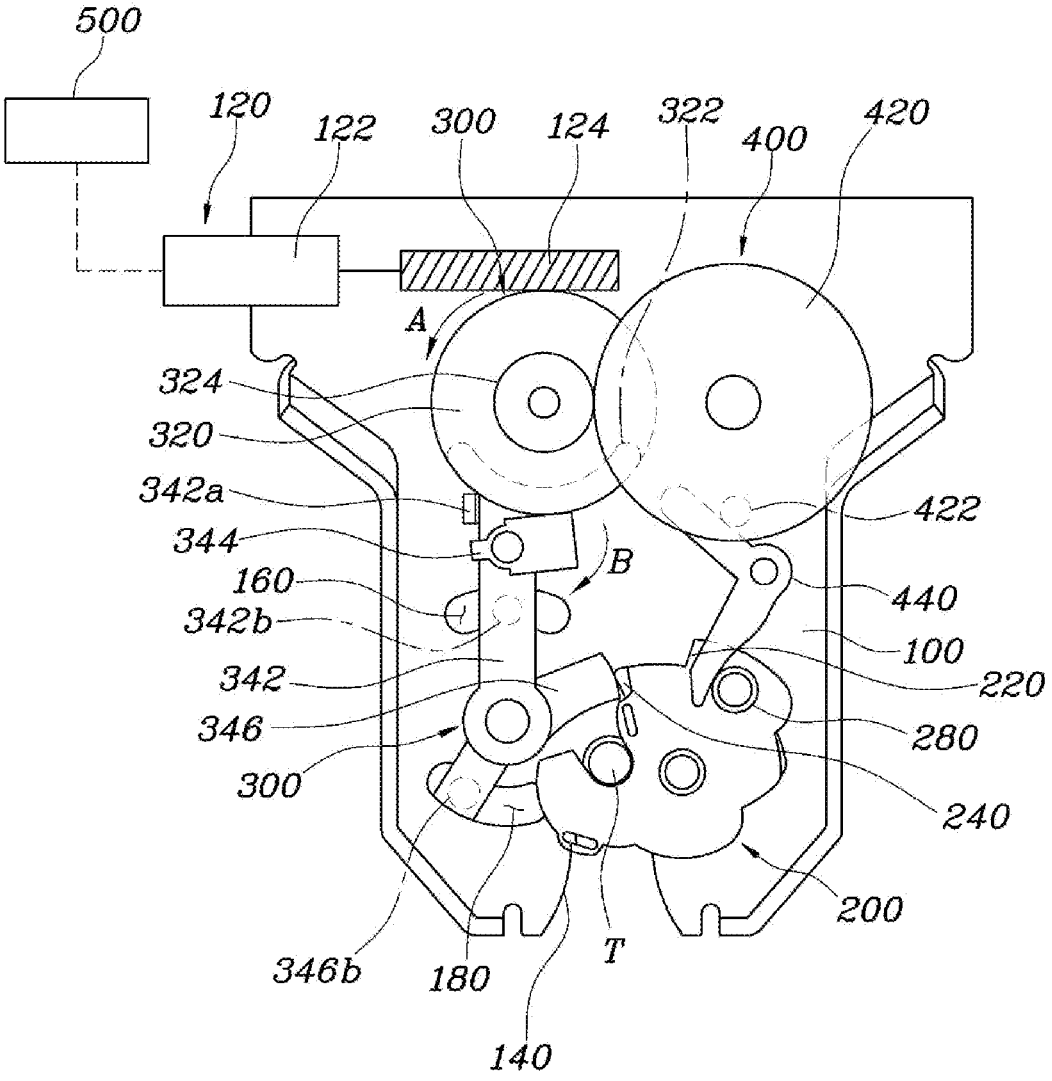
Figure 4:
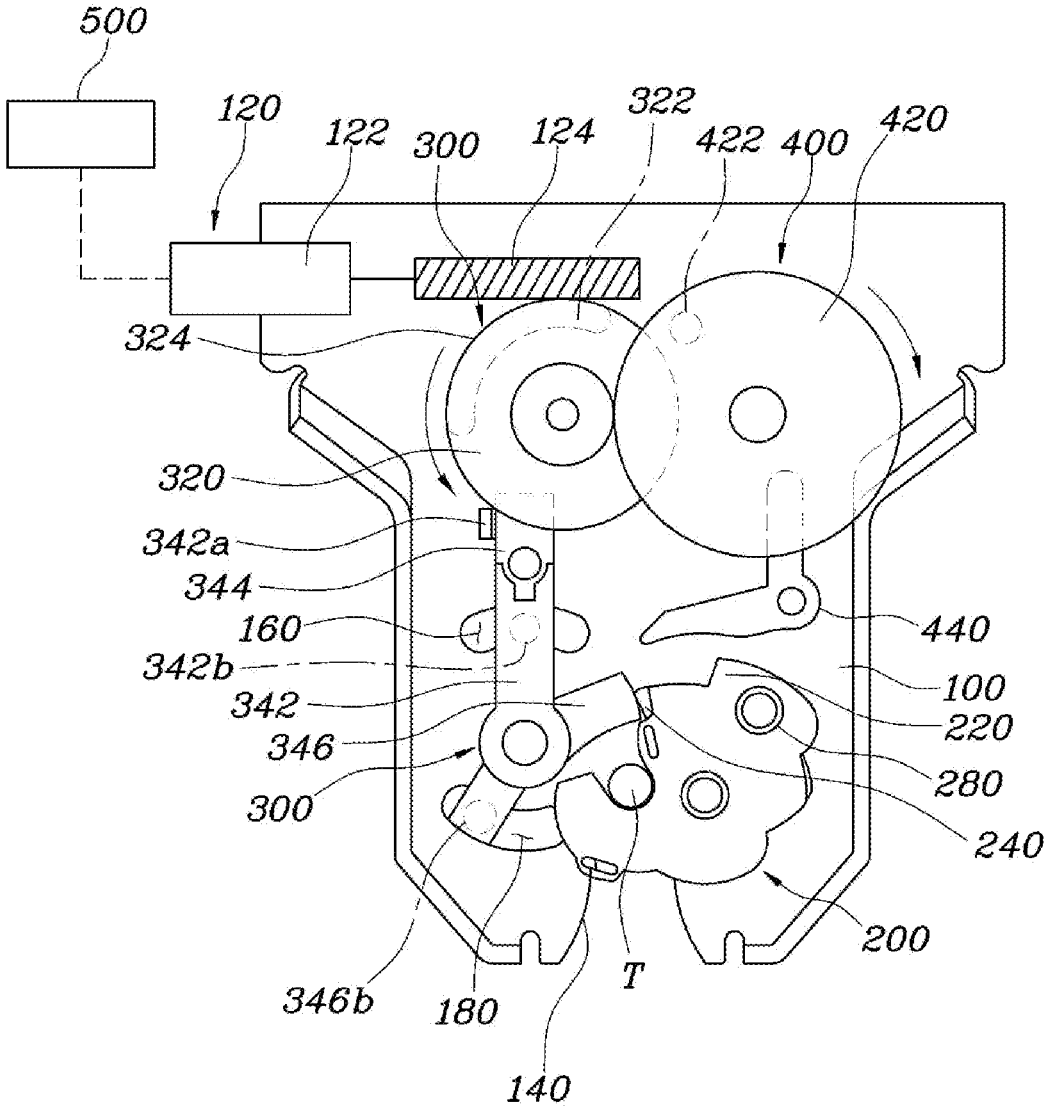
Figure 5:
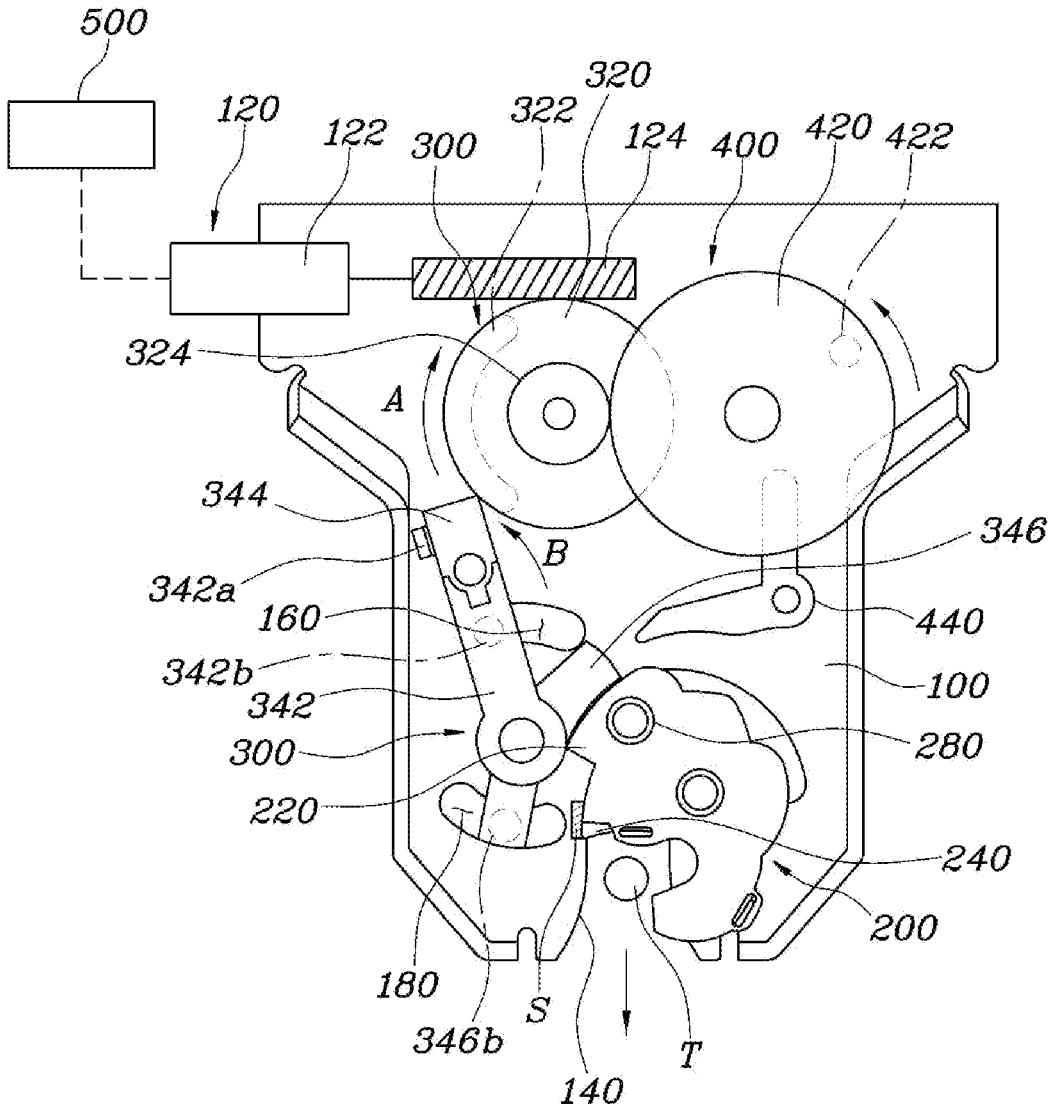
FIGS. 5 to 6 are views illustrating an unlocking operation of the latch apparatus of a tailgate for a vehicle according to an embodiment of the present invention.
Figure 6:
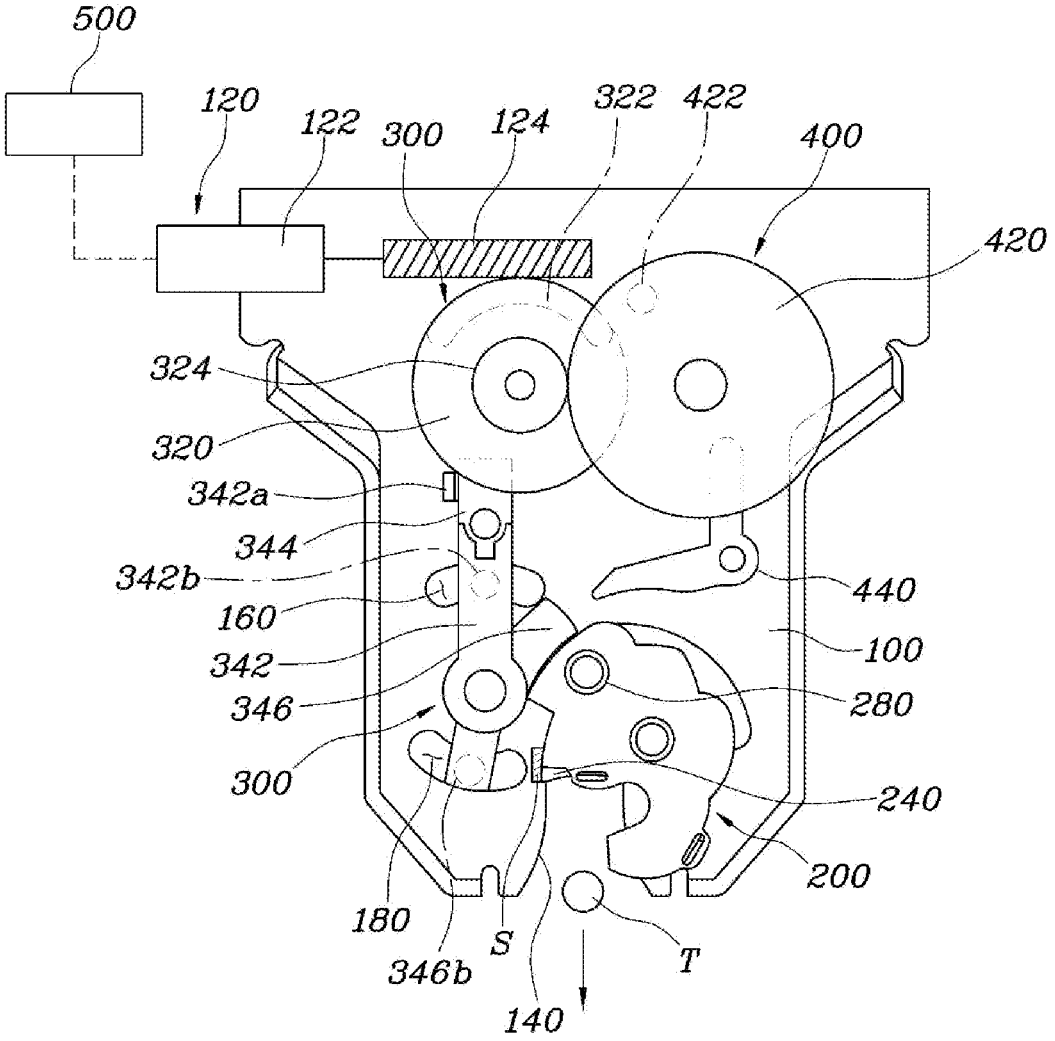

FIG. 1 is a view showing a latch apparatus of a tailgate for a vehicle according to an embodiment of the present invention, FIGS. 2 to 4 are views illustrating a closing operation of the latch apparatus of a tailgate for a vehicle according to an embodiment of the present invention, and FIGS. 5 to 6 are views illustrating an unlocking operation of the latch apparatus of a tailgate for a vehicle according to an embodiment of the present invention.

A latch apparatus of a tailgate for a vehicle according to an embodiment of the present invention, as shown in FIG. 1, includes: a base 100 supporting a driving motor 120 for supplying power and having an insertion groove 140 for inserting a striker T; a latch lever 200 rotatably disposed close to the insertion groove 140 of the base 100 being pushed to rotate when the striker T is inserted into the insertion groove 140, and covering the striker T inserted in the insertion groove 140; a release unit 300 disposed close to the latch lever 200 on the base 100, transmitting power from the driving motor 120, fixing the position of the latch lever 200 rotating to cover the striker T, and allowing the latch lever 200 to rotate when the driving motor 120 is operated; and a cinching unit 400 disposed close to the release unit 300 on the base 100, being operated by the power from the driving motor 120, and further rotating the latch lever 200 to restrict the striker T inserted in the insertion groove 140 when the driving motor 120 is operated with the latch lever 200 covering the striker T.

That is, an embodiment of the present invention includes the latch lever 200, the release unit 300, and the cinching unit 400 in the base 100, in which the latch lever 200 covers the striker T when the striker T is inserted in the insertion groove 140 of the base 100 to lock a tailgate. The latch lever 200 can be elastically supported to rotate in the direction in which the striker T is separated from the insertion groove 140, and the latch lever 200 can be elastically rotated by a torsion spring connecting the latch lever 200 and the base 100 to each other. The release unit 300 and the cinching unit 400 are provided to rotate the latch lever 200. As the release unit 300 and the cinching unit 400 are operated, the latch lever 200 is rotated to perform second locking for completely locking the striker T covered by the latch lever 200 or to perform unlocking by separating the striker T from the latch lever 200.

In detail, according to an embodiment of the present invention, as shown in FIG. 1, a first fixing protrusion 220 that protrudes radially around the latch lever 200, a second fixing protrusion 240 that protrudes at a height different from the first fixing protrusion 220, and a latch groove 260 for inserting the striker T may be sequentially formed at the latch lever 200.

In the latch lever 200, the latch groove 260, the second fixing protrusion 240, and the first fixing protrusion 200 are sequentially formed in the rotational direction when the striker T is inserted, and the first fixing protrusion 220 may protrude further than the second fixing protrusion 240.

As described above, the latch lever 200 has the first fixing protrusion 220, the second fixing protrusion 240, and the latch groove 260 sequentially formed around it. The first fixing protrusion 220 and the second fixing protrusion 240 are parts that the release unit 300 is supposed to come in contact with, so when the latch lever 200 is rotated, the release unit 300 restricts rotation of the latch lever 200 by coming in contact with the first fixing protrusion 220 or the second fixing protrusion 240 to keep the latch lever 200 in a first locking state or a second locking state. The first locking state may be a state when the striker T is incompletely inserted in the insertion groove 140 of the base 100 and the second locking state may be a state when the striker T is completely inserted and locked in the insertion groove 140 of the base 100.

Further, the latch groove 260 of the latch lever 200 is provided to cover the striker T when the striker T is inserted in the insertion groove 140. Accordingly, the latch lever 200 can lock a tailgate in a first locking state or a second locking state through the first fixing protrusion 220 or the second fixing protrusion 240 and can cover and restrict the striker T when the striker T is inserted in the latch groove 260.

On the other hand, as can be seen in FIG. 1, the release unit 300 may include: a main gear 320 that is rotatably disposed on the base 100 and is rotated by the power from the driving motor 120; and a release lever 340 that is disposed close to the main gear 320 and is rotated in contact with the main gear 320 within a predetermined rotational range of the main gear 320 when the main gear 320 is rotated. Accordingly, when the driving motor 120 is operated, the main gear 320 is rotated and the release lever 340 is rotated, so rotation of the latch lever 200 can be restricted or allowed.

In detail, the main gear 320 has an operating protrusion extending a predetermined length in the circumferential direction, and the release lever 340 is rotatably disposed on the base 100 with a first end positioned in the rotational radius of the operating protrusion 322 according to the rotation of the main gear 320 and a second end positioned in the rotational radius of the latch lever 200. The operating protrusion 322 is formed on the surface of the main gear 320 that faces the base 100, and the release lever 340 is positioned between the main gear 320 and the base 100, so it is possible to prevent the operating protrusion 322 from interfering with a sub-gear 420 when the main gear 320 is rotated, which will be described below.

The release lever 340 may include: a rotary bar 342 that is rotatably disposed on the base 100 and is elastically supported to be rotated toward the latch lever 200; an operating bar 344 that is disposed at a first end of the rotary bar 342 to be rotated only in one direction, is elastically supported to be returned to its initial position, and extends within the rotational radius of the operating protrusion 322; and a fixing bar 345 that is rotatably disposed at a second end of the rotary bar 342 and is elastically supported to be rotated toward the latch lever 200.

Accordingly, when the driving motor 120 is operated, the main gear 320 is rotated and the operating bar 344 of the release lever 340 is pushed and rotated by the operating protrusion 322, so the rotary bar 342 connected to the operating bar 344 is rotated. Further, as the rotary bar 342 is rotated, the fixing bar 346 connected to the second end of the rotary bar 342 can be separated from the latch lever 200.

However, a fixing projection 342*a* is formed on a side of the first end of the rotary bar 342 to prevent the operating bar 344 from rotating toward the fixing projection 342*a*, so the rotary bar 344 can only be rotated away from the fixing projection 342*a* on the rotary bar 342. Accordingly, the fixing bar 346 can be separated from the latch lever 200, or can be maintained in contact with the latch lever 200 in the rotational direction of the main gear 320.

That is, referring to FIG. 5, when the main gear 320 is rotated in the direction of the arrow A, the operating bar 344 being in contact with the operating protrusion 322 of the main gear 320 is rotated in the direction of the arrow B, but the operating bar 344 cannot be rotated by the fixing projection 342*a* on the rotary bar 342, so the rotary bar 342 is rotated with the operating bar 344 in the direction of the arrow B, whereby the fixing bar 346 connected to the rotary bar 342 can be separated from the latch lever 200. On the contrary, referring to FIG. 3, when the main gear 320 is rotated in the direction of the arrow A, the operating bar 344 being in contact with the operating protrusion 322 of the main gear 320 is rotated in the direction of the arrow B. In this process, the operating bar 344 can be rotated in the direction of the arrow B, that is, the operating bar 344 can be independently rotated on the rotary bar 342. Accordingly, the release unit 300 can be operated in cooperation with or independently from the cinching unit 400 to be described below.

The operating bar 344 can be elastically returned to its initial position by a torsion spring connected to the rotary bar 342 and the fixing bar 346 can be rotated toward the latch lever 200 by the torsion spring connected to the rotary bar 342. The returning structure using a torsion spring is not shown in the figures.

On the other hand, as shown in FIG. 1, a first guide groove 160 extending a predetermined distance in the rotational direction of the rotary bar 342 is formed in the base 100 and a first guide protrusion 342*b* that is inserted in the first guide groove 160 is formed on the rotary bar 342, so the rotary bar 342 can be rotated as much as the length of the first guide groove 160.

As described above, since the rotary bar 342 is connected to the first guide groove 160 through the first guide protrusion 342*b*, it can rotate the length of the first guide groove 160, so excessive rotation of the rotary bar 342 is prevented and the rotation of the latch lever 200 can be precisely restricted or allowed.

Further, a second guide groove 180 extending a predetermined length in the rotational direction of the fixing bar 346 is formed in the base 100 and a second guide protrusion 346*b* that is inserted in the second guide groove 180 is formed on the fixing bar 346, so the fixing bar 346 can be rotated an amount corresponding to the length of the second guide groove 180.

As described above, since the fixing bar 346 is connected to the second guide groove 180 through the second guide protrusion 346*b*, it can rotate the length of the second guide groove 180, so excessive rotation of the fixing bar 346 is prevented and the rotation of the latch lever 200 can be precisely restricted or allowed.

Further, as shown in FIG. 1, an engaging portion 324 protrudes on the main gear 324 and the cinching unit 400 may include: a sub-gear 420 that is rotatably disposed on the base 100, is engaged with the engaging portion 324, and is rotated by the power from the driving motor 120; and a cinching lever 440 that is disposed close to the sub-gear 420 and is rotated within a predetermined rotational range of the sub-gear 420 in contact with the sub-gear 420 when the sub-gear 420 is rotated. The cinching lever 440 can be returned to its initial position by the torsion spring connected to the base 100.

Accordingly, when the driving motor 120 is operated, the sub-gear 420 engaged with the engaging portion 324 of the main gear 320 is rotated and the cinching lever 440 is rotated, whereby the latch lever 200 can be rotated. In this configuration, it is possible to adjust the force using a gear ratio by making the radii of the engaging portion 324 and the sub-gear 420 different and it is also possible to adjust the number of rotations of the sub-gear 420 depending on the number of rotations of the engaging portion 324 by adjusting the gear ratio between the engaging portion 324 and the sub-gear 420.

Meanwhile, a locking portion 422 protrudes on a side of the sub-gear 420 and the cinching lever 440 may be rotatably disposed on the base 100 with a first end positioned in the rotational radius of the locking portion 422 depending on the rotation of the sub-gear 420 and a second end extending to be able to come in contact with the latch lever 200. The locking portion 422 may be formed on the side of the sub-gear 420 that faces the base 100 and the cinching lever 440 may be positioned between the sub-gear 420 and the base 100.

A locking protrusion 280 is formed on the latch lever 200 to lock the second end of the cinching lever 440, so when the sub-gear 420 is rotated, the locking portion 422 pushes and rotates the first end of the cinching lever 440 and the second end of the cinching lever 440 pushes the locking protrusion 280 on the latch lever 200, so the latch lever 200 can be rotated.

In the cinching lever 440, the first end extending toward the sub-gear 420 and the second end extending to come in contact with the latch lever 200 form a predetermined angle, so when the cinching lever 440 is rotated, the latch lever 200 can be rotated only within a predetermined range. The angle made by the first end and the second end of the cinching lever 440 may be determined such that the fixing bar 346 of the release unit 300 is moved from the first fixing protrusion 220 to the second fixing protrusion 240, when the latch lever 200 is rotated by the rotation of the cinching lever 440.

The operational relationship between the release unit 300 and the cinching unit 400 will be described below again.

Meanwhile, the driving motor 120 may be composed of a motor unit 122 that generates torque and a screw 124 that is rotated by the torque from the motor unit 122 and the screw 124 may be engaged with the main gear 320 of the release unit 300. Accordingly, when the motor unit 122 is operated, the screw 124 is rotated and the main gear 320 is rotated, so the cinching unit 400 can be operated with the release lever 340 that is operated with the rotation of the main gear 320.

A sensor S that senses whether the striker T is inserted and a controller 500 that controls the driving motor 120 and receives signals from the sensor S are further disposed on the base 100. When the striker T is inserted in the insertion groove 140, the controller 500 can operate the driving motor 120 so that the cinching unit 400 is operated and the latch lever 200 is further rotated, thereby restricting the striker T inserted in the insertion groove 140.

The sensor S may be disposed in the insertion groove 140 of the base 100 and can sense whether the striker T is inserted using terminal contact depending on the rotational position of the striker T or the latch lever 200 and can check that the striker T is inserted by detecting the rotational angle of the latch lever 200. The technology for detecting whether a tailgate is opened/closed is well known in the art, so it is possible to sense that the striker T is inserted in the insertion groove 140 using various methods.

The controller 500 transmits a signal to operate the driving motor 120 in response to a signal from the sensor S. That is, when the striker T is inserted in the insertion groove 140 and is covered by the latch lever 200, it is recognized as the first locking state, and it is possible to change the first locking state into the second locking state in which the driving motor 120 is operated to operate the cinching unit 400, the latch lever 200 is further rotated, and the striker T is fully restricted in the insertion groove 140, when it is required to completely close the tailgate.

Further, when an instruction to open a trunk is given, the controller 500 can release the latch lever 200 by operating the driving motor 120 to operate the release unit 300. That is, when it is required to open a trunk in accordance with the intention of a user, the controller 500 operates the driving motor 120 so that the release unit 300 is operated and the latch lever 200 is released, whereby the striker T can be separated from the insertion groove 140 of the base 100. The latch lever 200 is elastically supported to be rotated in the direction in which the striker T is separated from the insertion groove 140, so the latch lever 200 pushes the striker T so that the striker T is naturally separated by the latch lever 200. A torsion spring may be disposed on the base 100 to elastically support the latch lever 200.

The operation of the latch apparatus of a tailgate for a vehicle of an embodiment of the present invention is described hereafter.

First, according to the operation of closing a tailgate, as shown in FIG. 1, the latch lever 200 has been rotated to correspond to the insertion groove 140 in the initial state and the release unit 300 and the cinching unit 400 are in the initial state, so the fixing bar 346 of the release unit 300 is in contact with the outer surface of the latch lever 200 not to interfere with the rotation of the latch lever 200.

In this state, when the striker T is inserted into the insertion groove 140, as shown in FIG. 2, the latch lever is pushed and rotated by the striker T and the fixing bar 346 of the release unit 300 is locked to the first fixing protrusion 220 of the latch lever 200, whereby the rotation of the latch lever 200 is restricted. In this state, the tailgate is not completely closed, which may be the first locking state.

In order to completely close the tailgate, as shown in FIG. 2, the driving motor 120 is operated and the main gear 320 and the sub-gear 420 are rotated together. The operating bar 344 that is operated with the main gear 320 is independently rotated on the rotary bar 342, but the rotary bar 342 and the fixing bar 346 are not rotated, so the fixing bar 346 stays locked to the first locking protrusion 220 of the latch lever 200. Meanwhile, the cinching lever 440 that is rotated with the sub-gear 420, as shown in FIG. 3, pushes the locking protrusion 280 of the latch lever 220, so the latch lever 200 is further rotated. Accordingly, the striker T is completely inserted into the insertion groove 140 of the base 100 and locked by the latch lever 200.

Thereafter, as shown in FIG. 4, the cinching lever 440 is returned to its initial position and the fixing bar 346 is locked to the second fixing protrusion 240 of the latch lever 200 to achieve the second locking state, so the tailgate is completely closed.

On the other hand, in order to open the tailgate, as shown in FIG. 5, the driving motor 120 is operated in reverse and the main gear 320 and the sub-gear 420 are rotated in the direction opposite to that for closing. The operating bar 344 being in contact with the operating protrusion 322 of the main gear 320 is also rotated, but the rotation of the operating bar 344 is restricted by the fixing projection 342*a* on the rotary bar 342, so the operating bar 344 rotates with the rotary bar 342. Accordingly, the fixing bar 346 connected to the rotary bar 342 is also rotated and separated from the second fixing protrusion 240 of the latch lever 200, so the latch lever 200 is allowed to rotate and elastically returned to its initial position, thereby pushing the striker T such that the striker T is separated from the insertion groove 140.

Thereafter, as shown in FIG. 6, the release lever 340 is returned to its initial position and the fixing bar 346 is returned to its initial state to come in contact with the outer side of the latch lever 200.

Further, when the tailgate is opened by an obstacle in the first locking state, the release unit 300 and the cinching unit 400 can be operated in the same way to immediately open the tailgate such that the striker T is separated from the insertion groove 140.

According to the latch apparatus of a tailgate for a vehicle which has the structure described above, a tailgate that is incompletely closed can be completely closed. In particular, it is possible to reduce the overall size and weight by simplifying the cinching structure for completely closing a trunk.

Although the present invention was described with reference to specific embodiments shown in the drawings, it is apparent to those skilled in the art that the present invention may be changed and modified in various ways without departing from the scope of the present invention, which is described in the following claims.

What is claimed is:

1. A latch apparatus of a tailgate for a vehicle, the apparatus comprising:

a base supporting a driving motor for supplying power and having an insertion groove for inserting a striker;

a latch lever rotatably disposed close to the insertion groove of the base, the latch lever being pushed to rotate when the striker is inserted into the insertion groove, and covering the striker inserted in the insertion groove;

a release unit disposed close to the latch lever on the base, the release unit configured to transmit power from the driving motor, fix a position of the latch lever rotating to cover the striker, and allow the latch lever to rotate when the driving motor is operated, wherein the release unit comprises:

a main gear rotatably disposed on the base and rotated by power from the driving motor; and a release lever disposed close to the main gear and rotated in contact with the main gear within a predetermined rotational range of the main gear when the main gear is rotated, wherein the main gear comprises an operating protrusion extending a predetermined length in a circumferential direction and the release lever is rotatably disposed on the base with a first end positioned in a rotational radius of the operating protrusion according to rotation of the main gear and a second end positioned in a rotational radius of the latch lever; and a cinching unit disposed close to the release unit on the base, the cinching unit being operated by the power from the driving motor, and further rotating the latch lever to restrict the striker inserted in the insertion groove when the driving motor is operated with the latch lever covering the striker.

2. The apparatus of claim 1, wherein the release lever includes:

a rotary bar rotatably disposed on the base and elastically supported to be rotated toward the latch lever;

an operating bar disposed at a first end of the rotary bar to be rotated only in one direction and extending within the rotational radius of the operating protrusion; and a fixing bar rotatably disposed at a second end of the rotary bar and elastically supported to be rotated toward the latch lever.

3. The apparatus of claim 2, wherein a fixing projection is formed on a side of the first end of the rotary bar to prevent the operating bar from rotating toward the fixing projection.

4. The apparatus of claim 2, wherein a guide groove extending a predetermined distance in a rotational direction of the rotary bar is formed in the base, and a guide protrusion inserted in the guide groove is formed on the rotary bar, wherein the rotary bar is rotated an amount corresponding to a length of the guide groove.

5. The apparatus of claim 2, wherein a guide groove extending a predetermined distance in a rotational direction of the fixing bar is formed in the base, and a guide protrusion inserted in the guide groove is formed on the rotary bar, wherein the fixing bar is rotated an amount corresponding to a length of the guide groove.

6. The apparatus of claim 1, wherein the driving motor is composed of a motor unit generating torque and a screw rotated by the torque from the motor unit, and the screw is engaged with the main gear of the release unit.

7. The apparatus of claim 1, wherein the driving motor is composed of a motor unit generating torque and a screw rotated by the torque from the motor unit, and the screw is engaged with the main gear of the release unit.

8. A latch apparatus of a tailgate for a vehicle, the apparatus comprising:

a base supporting a driving motor for supplying power and having an insertion groove for inserting a striker;

a latch lever rotatably disposed close to the insertion groove of the base, the latch lever being pushed to rotate when the striker is inserted into the insertion groove, and covering the striker inserted in the insertion groove;

a release unit disposed close to the latch lever on the base, the release unit configured to transmit power from the driving motor, fix a position of the latch lever rotating to cover the striker, and allow the latch lever to rotate when the driving motor is operated, wherein the release unit comprises:

a main gear rotatably disposed on the base and rotated by power from the driving motor;

a release lever disposed close to the main gear and rotated in contact with the main gear within a predetermined rotational range of the main gear when the main gear is rotated, wherein the main gear comprises an operating protrusion extending a predetermined length in a circumferential direction and the release lever is rotatably disposed on the base with a first end positioned in a rotational radius of the operating protrusion according to rotation of the main gear and a second end positioned in a rotational radius of the latch lever; and a cinching unit disposed close to the release unit on the base, the cinching unit being operated by the power from the driving motor, and further rotating the latch lever to restrict the striker inserted in the insertion groove when the driving motor is operated with the latch lever covering the striker, wherein an engaging portion protrudes on the main gear, and wherein the cinching unit includes:

a sub-gear rotatably disposed on the base, the sub-gear being engaged with the engaging portion, and rotated by the power from the driving motor; and a cinching lever disposed close to the sub-gear and rotated within a predetermined rotational range of the sub-gear in contact with the sub-gear when the sub-gear is rotated.

9. The apparatus of claim 8, wherein a locking portion protrudes on a side of the sub-gear, and the cinching lever is rotatably disposed on the base with a first end positioned in a rotational radius of the locking portion depending on rotation of the sub-gear and a second end extending to be able to come in contact with the latch lever.

10. The apparatus of claim 9, wherein a locking protrusion is formed on the latch lever to lock the second end of the cinching lever.

11. The apparatus of claim 9, wherein, in the cinching lever, the first end extending toward the sub-gear and the second end extending to come in contact with the latch lever form a predetermined angle therebetween.

12. A vehicle comprising:

a trunk; and a latch apparatus configured to completely close the trunk, the latch apparatus comprising:

a base supporting a driving motor for supplying power and having an insertion groove for inserting a striker;

a latch lever rotatably disposed close to the insertion groove of the base, the latch lever being pushed to rotate when the striker is inserted into the insertion groove, and covering the striker inserted in the insertion groove;

a release unit disposed close to the latch lever on the base, the release unit configured to transmit power from the driving motor, fix a position of the latch lever rotating to cover the striker, and allow the latch lever to rotate when the driving motor is operated, wherein the release unit comprises:

a main gear rotatably disposed on the base and rotated by power from the driving motor, and a release lever disposed close to the main gear and rotated in contact with the main gear within a predetermined rotational range of the main gear when the main gear is rotated, wherein the main gear comprises an operating protrusion extending a predetermined length in a circumferential direction and the release lever is rotatably disposed on the base with a first end positioned in a rotational radius of the operating protrusion according to rotation of the main gear and a second end positioned in a rotational radius of the latch lever; and a cinching unit disposed close to the release unit on the base, the cinching unit being operated by the power from the driving motor, and further rotating the latch lever to restrict the striker inserted in the insertion groove when the driving motor is operated with the latch lever covering the striker.

13. The vehicle of claim 12, wherein the release lever includes:

a rotary bar rotatably disposed on the base and elastically supported to be rotated toward the latch lever;

an operating bar disposed at a first end of the rotary bar to be rotated only in one direction and extending within the rotational radius of the operating protrusion; and a fixing bar rotatably disposed at a second end of the rotary bar and elastically supported to be rotated toward the latch lever.

14. The vehicle of claim 13, wherein a fixing projection is formed on a side of the first end of the rotary bar to prevent the operating bar from rotating toward the fixing projection.

15. The vehicle of claim 13, wherein a guide groove extending a predetermined distance in a rotational direction of the rotary bar is formed in the base, and a guide protrusion inserted in the guide groove is formed on the rotary bar, wherein the rotary bar is rotated an amount corresponding to a length of the guide groove.

16. The vehicle of claim 13, wherein a guide groove extending a predetermined distance in a rotational direction of the fixing bar is formed in the base, and a guide protrusion inserted in the guide groove is formed on the rotary bar, wherein the fixing bar is rotated an amount corresponding to a length of the guide groove.

17. The vehicle of claim 12, wherein an engaging portion protrudes on the main gear, and wherein the cinching unit includes:

a sub-gear rotatably disposed on the base, the sub-gear being engaged with the engaging portion, and rotated by the power from the driving motor; and a cinching lever disposed close to the sub-gear and rotated within a predetermined rotational range of the sub-gear in contact with the sub-gear when the sub-gear is rotated.

18. The vehicle of claim 17, wherein a locking portion protrudes on a side of the sub-gear, and the cinching lever is rotatably disposed on the base with a first end positioned in a rotational radius of the locking portion depending on rotation of the sub-gear and a second end extending to be able to come in contact with the latch lever.

19. The vehicle of claim 18, wherein a locking protrusion is formed on the latch lever to lock the second end of the cinching lever.

20. The vehicle of claim 18, wherein, in the cinching lever, the first end extending toward the sub-gear and the second end extending to come in contact with the latch lever form a predetermined angle therebetween.

* * * * *